US009139325B2

(12) United States Patent
Madrid et al.

(10) Patent No.: US 9,139,325 B2
(45) Date of Patent: Sep. 22, 2015

(54) SELF RIGHTING CONTAINER

(76) Inventors: Maurice H Madrid, Upland, CA (US); R Bruce Harris, Upland, CA (US)

( * ) Notice: Subject to any disclaimer, the term of this patent is extended or adjusted under 35 U.S.C. 154(b) by 310 days.

(21) Appl. No.: 12/711,809

(22) Filed: Feb. 24, 2010

(65) Prior Publication Data

US 2011/0204066 A1 Aug. 25, 2011

(51) Int. Cl.

| | |
|---|---|
| ***B65D 25/24*** | (2006.01) |
| ***B65D 6/28*** | (2006.01) |
| ***B65D 1/02*** | (2006.01) |
| ***B65D 23/00*** | (2006.01) |

(52) U.S. Cl.

CPC ..... *B65D 1/0223* (2013.01); *B65D 23/00* (2013.01)

(58) Field of Classification Search

CPC ..... Y10S 248/91; A47G 2019/2294; A47G 19/2272; A47G 19/2261; A47G 19/2266

USPC ..... 220/631, 603; 215/370, 376, 398, 395; 248/910; D7/507, 510

See application file for complete search history.

(56) References Cited

U.S. PATENT DOCUMENTS

| | | | | | |
|---|---|---|---|---|---|
| 434,423 | A * | 8/1890 | Burrows | 220/603 |
| 1,645,525 | A * | 10/1927 | Fleming | 232/43.2 |
| 1,670,525 | A * | 5/1928 | Savery | 232/43.2 |
| 2,001,989 | A * | 5/1935 | Theuerkauf | 119/203 |
| 4,055,273 | A * | 10/1977 | Jones | 220/631 |
| 4,096,966 | A | 6/1978 | Korshak | |
| 4,303,170 | A * | 12/1981 | Panicci | 220/603 |
| 4,388,996 | A | 6/1983 | Panicci | |
| 6,168,034 | B1 * | 1/2001 | Perrone | 215/11.1 |
| 6,698,065 | B2 * | 3/2004 | Lauer | 16/436 |
| 6,776,303 | B2 * | 8/2004 | Fripps | 220/603 |
| 2008/0073358 | A1 * | 3/2008 | Jeuch et al. | 220/592.18 |
| 2008/0237371 | A1 * | 10/2008 | Hornsby et al. | 239/375 |
| 2008/0257845 | A1 * | 10/2008 | Rossi | 215/11.1 |

* cited by examiner

*Primary Examiner* — Shawn M Braden
(74) *Attorney, Agent, or Firm* — Greenberg Traurig, LLP

(57) ABSTRACT

A self righting fluid container having a flanged neck portion, a weighted base portion and an intermediate tapered section connecting the neck portion to the base portion. The center of gravity of the container, whether filled or empty, is along the centerline of the container on the positive side of a critical line which line extends normal to the horizontal plane of the support surface on which the container rests from a point where the container contacts the support surface and where the base portion intersects the tapered section.

15 Claims, 4 Drawing Sheets

SELF RIGHTING CONTAINER

CROSS REFERENCE TO RELATED APPLICATIONS

Not applicable

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATION-BY-REFERENCE OF MATERIAL SUBMITTED ON A COMPACT DISC

Not applicable

BACKGROUND OF THE INVENTION

1. Field of the Invention

The invention relates to fluid holding containers; and, more particularly, to a bottle which is self righting when tipped whether full or empty.

2. Description of the Prior Art Including Information Disclosed Under 37 CFR 1.97 and 1.98

Self righting bottles or containers are well known in the art. In U.S. Pat. No. 4,096,966 to Korshack, one such self righting container is disclosed in the form of a cup. Although Korshack attempts to find critical relationships between the cup diameter, the cup height, the small diameter of the base circular portion, and the diameter of the convex or part spherical portion at the lower portion of the cup, there is no teaching to apply to any container for self righting the same. Korshack's teachings are limited to a cup of the critical dimensional ratios set forth in his patent. In U.S. Pat. Nos. 4,303,170 and 4,388,996, Panicci discloses a self righting cup having a lower hemispherical portion and an upper portion of generally cylindrical form. Ratios are set forth for making a cup self righting. Again, only specific ratios are set forth for the cups of Panicci. There are no teachings that are applicable to any fluid filled container.

BRIEF SUMMARY OF THE INVENTION

It is an object of this invention to provide a self righting fluid containing container.

It is a further object of this invention to provide parameters for making any fluid containing container self righting.

These and other objects are preferably accomplished by providing a self righting fluid container having a flanged neck portion, a weighted base portion and an intermediate tapered section connecting the neck portion to the base portion. The center of gravity of the container, whether filled or empty, is along the centerline of the container on the positive side of a critical line extending normal to the horizontal plane of the supporting surface on which the container rests from a point where the container contacts the support surface and the base portion intersects the tapered section.

DETAILED DESCRIPTION OF THE INVENTION

Figure 1:
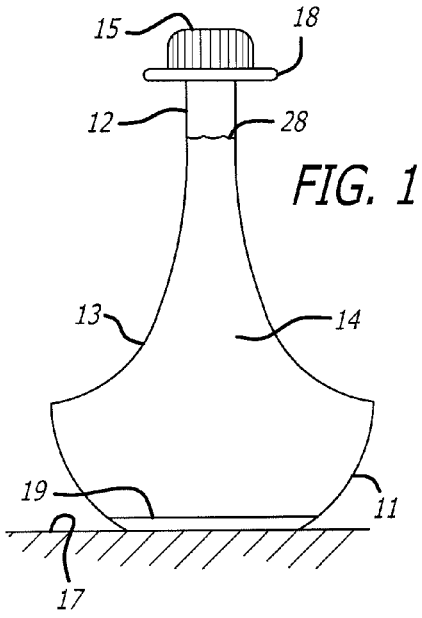
FIG. 1 is a vertical view of a self righting container in accordance with the invention disposed on a supporting surface.

Referring now to FIG. 1 of the drawing, a container 10 is shown in the form of a bottle for convenience of illustration. For purposes of computation, "bottle" or "container" may be used to refer to container 10. Container 10 has a rounded 10 bottom base portion 11, a neck portion 12, and tapered section 13. Container 10 is hollow so that it is adapted to contain a liquid 14 therein. Container 10 may also be transparent and of glass or plastic or the like. Neck portion 12 is thus closed off by a cap 15. Cap 15 may be threaded onto mating threads at the top of neck portion 12 or snapped onto a flange thereon as is well known in the container art so as to provide a fluid tight fit. Base portion 11 may have a generally flat bottom wall 16 (FIG. 2) for resting on support surface 17.

Figure 2:
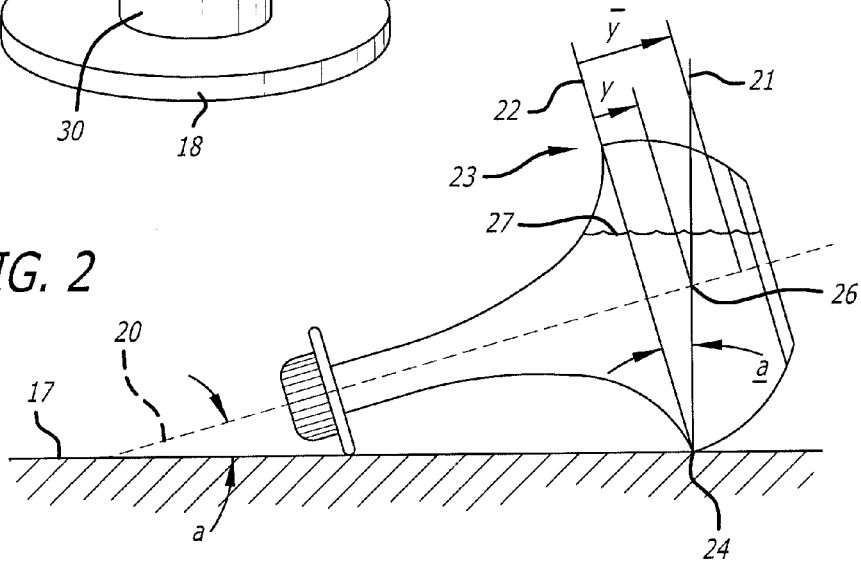
FIG. 2 is a vertical view, partly diagrammatic, of the container of FIG. 1 shown in a totally inclined position.

As particularly contemplated in the invention, self righting means are provided for self-righting container 10 if it is rocked or moved off of the upright position shown in FIG. 1, such as the inclined position shown in FIG. 2.

Thus, referring again to FIG. 1, such self-righting means includes an annular flange 18 on the bottom of cap 15 and a weighted member 19 at the bottom of base portion 11.

As seen in FIG. 2, an angle a is provided between the plane of surface 17 and the centerline 20 through container 10. This angle a is identical to angle a between a line 21 perpendicular to the plane of support surface 17 (beginning where the tip 24 of base portion 11 touches surface 17) and a line 22 extending from the point of intersection of line 21 with the plane of surface 17 to the tip 23 of the base portion 11 (i.e., where tapered section 13 merges into base portion 11). Note that tips 23, 24 lie along line 22 which is coincident with the perimeter of container 10 where base portion 11 merges into tapered section 13.

As seen in FIG. 2, line 21 is to the left of the center of gravity located at point 26. This point 26 is on the positive side of critical line 21 (on the right side of line 21 in FIG. 2). A positive restoring moment occurs when point 26 is on the positive side of the critical line 21. When such a positive restoring moment exists, container 10 rights itself. Container 10 will not right itself if the center of gravity or point 26 is on the negative side of the critical line 21 or on the critical line 21. The critical line 21 extends vertically from the point 24 where the truncated hemisphere base portion 11 of the container 10 contacts the horizontal surface 17. For a restoring moment to exist, the center of gravity point 26 of the entire container 10, including the fluid, must be on the positive side of the critical line 21. This is true for any fluid level and any tilt position. The base section 11 of the container 10 is a truncated hemisphere. The smooth exterior surface of the base portion 11 allows the container 10 easy transition from the tilted position of FIG. 2 to its upright position in FIG. 1. The stem or tapered section 13 tapers in toward the center line 20 of the container. The taper of section 13 serves to minimize the container volume on the negative side of the critical line 21.

Cap 15 may be replaced with a spray nozzle, if desired. The cap flange 18 serves as a grip support and as a maximum tilt limiting device. The cap flange 18 determines the angle at which the bottle will rest when it is tipped completely on its side. Increasing the radius of flange 18 effectively reduces the size of the weighted member 19 required. This is important since it is not desirable to have an excessively heavy container, full or empty.

Preferably, container 10 is thin walled. With a thin wall, the weight of the container can be ignored in the tapered section 13 and base section portion 11 since the fluid weight is much greater. The weighted member 19 is preferably of a high density material, such as lead. The use of a high density material for the weighted member 19 contributes to minimizing the volume of the weighted member 19.

The center of gravity 26 of the entire container 10 and fluid, where i=the material of container 10, is given by:

$$y = \frac{\Sigma y_i m_i}{\Sigma m_i}$$

where $y_i$=is distance to center of gravity or point 26 of element i as measured from the coordinate center, and $m_i$=is the mass of element i.

The bottle is divided into four sections for the purpose of calculating the center of gravity and mass. The four parts are the cap section 15, the stem section 13, the fluid base section 11, and the weighted section 14.

Cap Section 15

Figure 3:
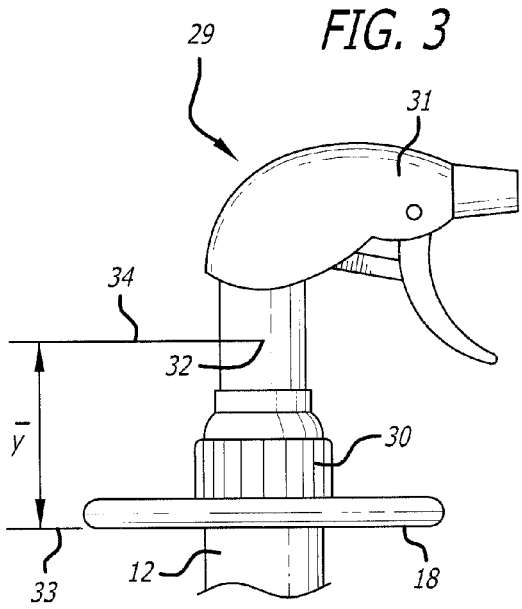
FIG. 3 is a vertical view of a modification of a portion of the container of FIGS. 1 and 2.
Figure 4:
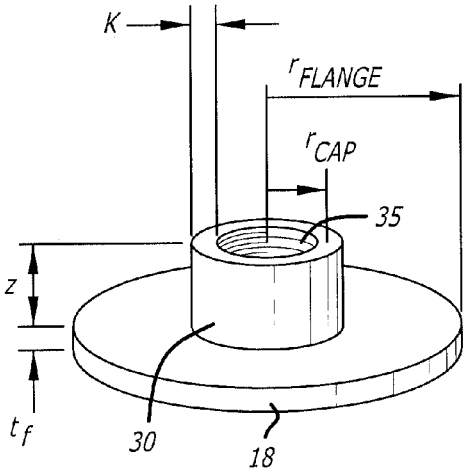
FIG. 4 is a perspective view of a portion of the spray nozzle top of FIG. 3.

The cap section includes the threaded portion of the container 10, the cap flange 18, and the cap 15 (or spray nozzle). As seen in FIG. 3, instead of cap 15, a spray nozzle top 29 is provided having a cap portion 30 threaded via threads (FIG. 4) onto neck portion 12, and a sprayer portion 31. The center of gravity is indicated at point 32, a distance y from the bottom horizontal plane 33 of flange 18 to the plane 34 parallel thereto. This analysis will discuss a nozzle end as in FIG. 3 as this would represent the worst case. The total mass of the cap section 15, 18 (or 18, 29) is the sum of the weights of the individual components. The weight of the cap flange 18 and threaded neck portion 12 are approximated based on a simplified component geometry and knowledge of the container material density (FIG. 4).

The mass of the cap threads and flange section is given by:

$$m_{fit}=\rho_{container}\pi(t_f(r^2_{flange}-r^2_{cap}+2kzr_{cap})$$

where $\rho_{container}$=density of the container material

The mass of the spray nozzle top 29, $m_{nozzle}$, is estimated at 001 lbs. The center of gravity for the nozzle top 29 is estimated at one inch above the flange base line 33 (FIG. 3). The center of gravity of the cap section relative to the coordinate center is given by:

$$Y_{cap}=1+L+n$$

The total mass of the top 29 is given by:

$$m_{cap}=m_{nozzle}+m_{fit}$$

$M_{nozzle}$ is the mass of the spray nozzle portion 31 with $M_{cap}$ being the total mass of top 29.

Stem Section

Figure 5:
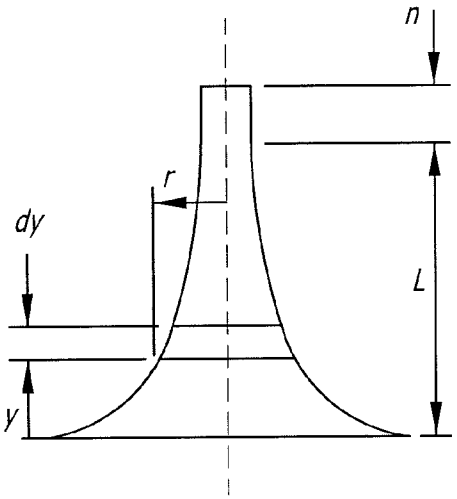
FIG. 5 is a vertical diagrammatic view of the stem section alone of the container of FIGS. 1 to 4.

The mass and center of gravity of the stem section (neck portion 12 and tapered section 13) are found by integrating along its length. The stem section 12, 13 is divided into two portions, a straight portion 12 and a curved portion 13. To facilitate the integration of the curved portion 13, a non-dimensional fourth order polynomial is used to define the changing stem radius along the length of the stem section 12, 13. The use of a non-dimensional expression allows variation in the container geometry without reevaluating the polynomial coefficient as shown in FIG. 5.

The fourth order polynomial of r(y) is given as:

$$r = (r_{max} - r_{cap})\left[a - b\left(\frac{y}{L}\right) + c\left(\frac{y}{L}\right)^2 - d\left(\frac{y}{L}\right)^3 + e\left(\frac{y}{L}\right)^4\right] + r_{cap}$$

The coefficients for the particular polynomial used in the preliminary design are presented in Table 1.

Table 1 Polynomial coefficients r coefficients a=0.99850 b=3.6699 c=6.2854 d=5.5478 e=1.9314

Figure 6:
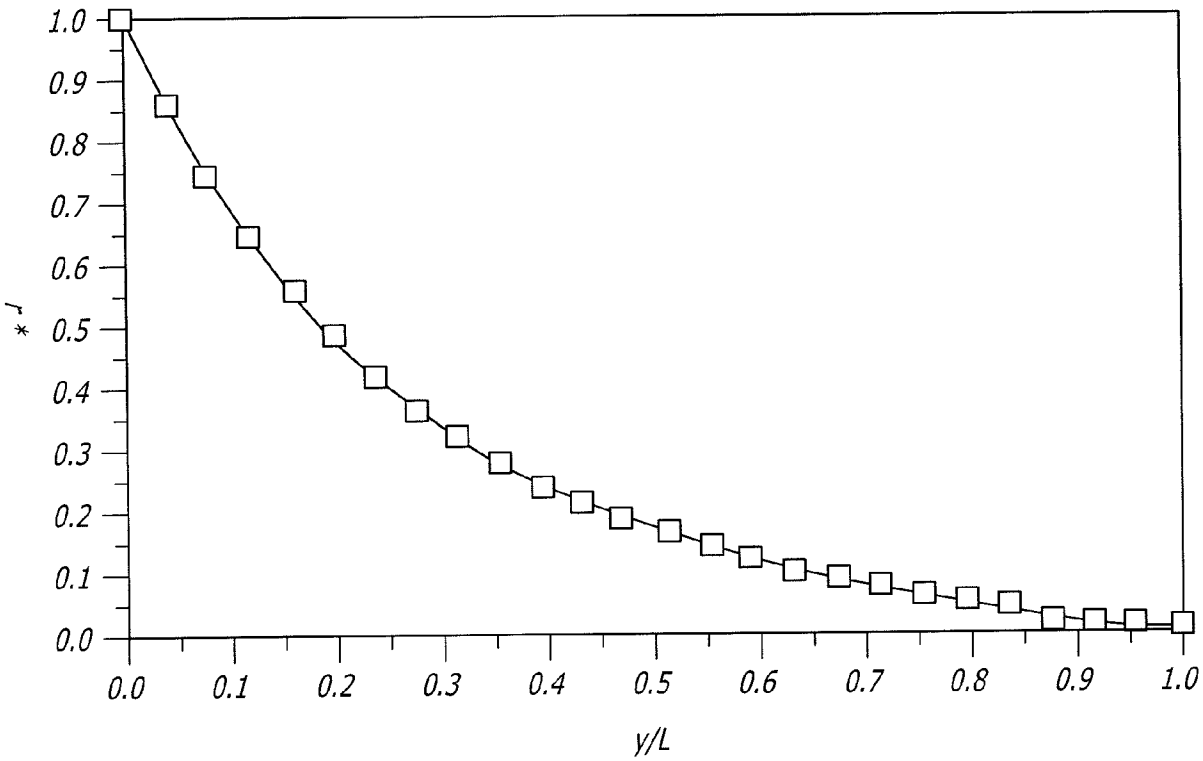
FIG. 6 is a graph of the curve of the stem section of FIG. 5.

A plot of the non-dimensional polynomial is presented in FIG. 6 where $r^*=r/r_{max}-r_{cap}$).

$$r^*=0.99850-3.6699y/L+6.2854(Y/L)^2-5.5478(Y/L)^3+1.9314(y/L)^4R^2=1.000$$

The distance to the center of gravity of the curved portion 13 of the stem 12, 13 is given by:

$$\bar{y}_{stem\ curve} = \frac{\int y\,dV}{\int dV} \text{ where } dV = \pi r^2 dy$$

Substituting in the equation for r the integral becomes:

$$\bar{y}_{stem\ curve} = \frac{\int_0^L y\left\{(r_{max} - r_{cap})\left[a - b\frac{y}{L} + c\left(\frac{y}{L}\right)^2 - d\left(\frac{y}{L}\right)^3 + e\left(\frac{y}{L}\right)^4\right] + r_{cap}\right\}^2 dy}{\int_0^L \left\{(r_{max} - r_{cap})\left[a - b\frac{y}{L} + c\left(\frac{y}{L}\right)^2 - d\left(\frac{y}{L}\right)^3 + e\left(\frac{y}{L}\right)^4\right] + r_{cap}\right\}^2 dy}$$

The center of gravity of the straight portion of the stem section is given by:

$$\bar{y}_{stem\ straight} = \frac{\int_L^{L+n} y\,dV}{\int_L^{L+n} dV} \text{ where } dV = \pi r^2 dy$$

The straight portion of the stem of the radius is constant and is given by:

$$r=r_{cap}$$

After substituting the integral becomes:

$$\bar{y}_{stem\ straight}=\frac{\int_{L}^{L+n} y\pi r_{cap}^{2}dy}{\int_{L}^{L+n}\pi r_{cap}^{2}dy}$$

The mass of the fluid in the curved portion 13 of the stem section 12, 13 is given by:

$$m_{stem\ curve}=\int_0^L \rho dV \text{ where } dV=\pi r^2 dy$$

Substituting in the equation for r the integral becomes:

$$m_{stem\ curve}=\int_0^L \rho_{fluid}\pi\left\{(r_{max}-r_{cap})\left[a-b\frac{y}{L}+c\left(\frac{y}{L}\right)^2-d\left(\frac{y}{L}\right)^3+e\left(\frac{y}{L}\right)^4\right]+r_{cap}\right\}^2 dy$$

The mass of the fluid in the straight portion of the stem section 12, 13 is given by:

$$m_{stem\ straight}=\int_L^{L+n}\rho_{fluid}\pi r_{cap}^2 dy$$

The total mass of the stem section 12, 13 is given by:

$$m_{stem}=m_{stem\ curve}=m_{stem\ straight}$$

The center of gravity for the entire stem section 12, 13 is given by:

$$\bar{y}_{stem}=\frac{\bar{y}_{stem\ straight}m_{stem\ straight}+\bar{y}_{stem\ curved}m_{stem\ curved}}{m_{stem\ straight}+m_{stem\ curved}}$$

Base Section

Figure 7:
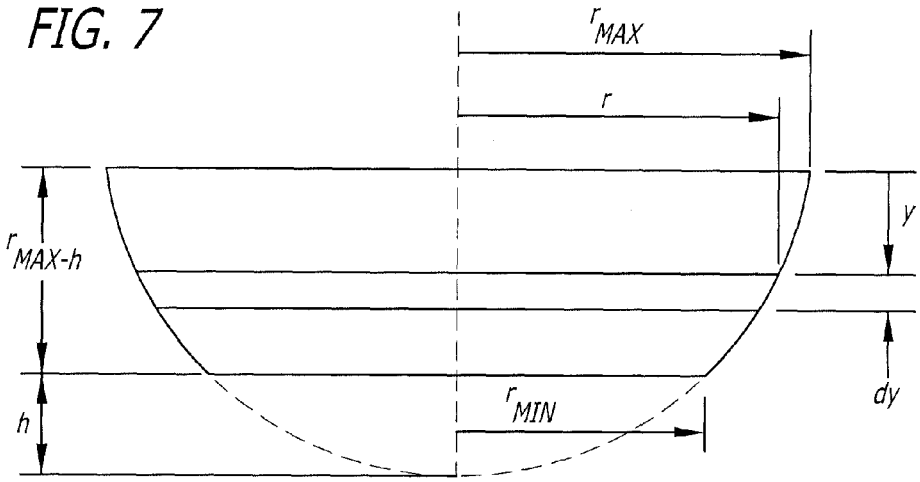
FIG. 7 is a diagrammatic illustration of the geometry of the fluid base portion 11 alone of the container of FIGS. 1 to 3.

The fluid base portion 11 consists of a truncated hemisphere (FIG. 7). The hemisphere radius is equivalent to the maximum radius of the stem section 12, 13. The location of the center of gravity for the fluid base portion 11 is given by:

$$\bar{y}_{fluid\ base}=\frac{\int_0^{r_{max-b}} y dV}{\int_0^{r_{max-b}} dV}$$

where $dV=\pi r^2 dy$ and $r=\sqrt{r_{max}^2-y^2}$

After substituting, the center of gravity location integral becomes:

$$\bar{y}_{fluid\ base}=\frac{\int_0^{r_{max-b}} y\pi(r_{max}^2-y^2)dy}{\int_0^{r_{max-b}}\pi(r_{max}^2-y^2)dy}$$

The mass of the base portion 11 is given by:

$$m_{fluid\ base}=\rho_{fluid}\int_0^{r\ max-b}dV$$

Which upon substitution becomes:

$$m_{fluid\ base}=\rho_{fluid}\int_0^{r\ max-b}\pi(r_{max}^2-y^2)dy$$

Weighted Section

Figure 8:
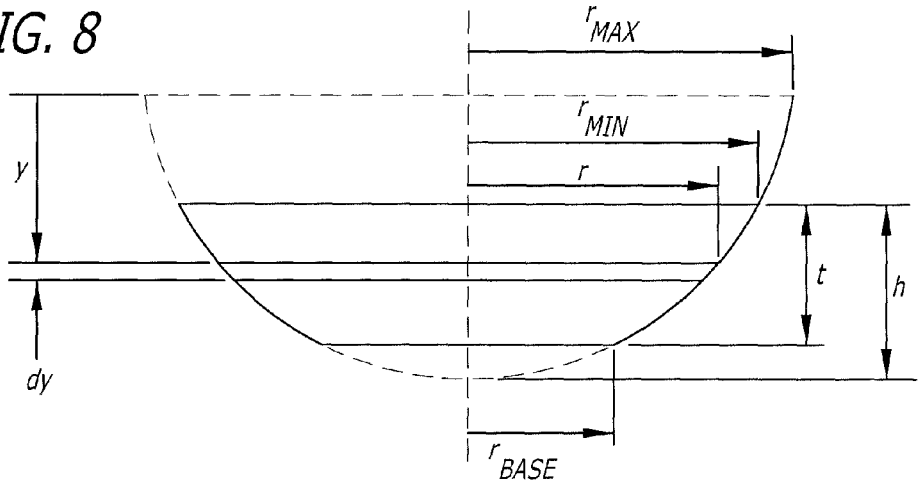
FIG. 8 is a diagrammatic illustration of the geometry of the weighted member 19 alone of the container of FIGS. 1 to 3.

The weighted section or member 19 of the container 10 is formed by a spherical segment located just below the fluid base section (FIG. 8).

The location of the center of gravity for the weighted section or member 19 is given by:

$$\bar{y}_{weight}=\frac{\int_{r_{max-h}}^{r_{max-h+1}} y dV}{\int_{r_{max-h}}^{r_{max-h+1}} dV}$$

where $dV=\pi r^2 dy$ and $r^2=r^{2max-y}2$

Substituting the center of gravity location integral becomes:

$$\bar{y}_{weight}=\frac{\int_{r_{max-h}}^{r_{max-h+1}} y\pi(r_{max}^2-y^2)dy}{\int_{r_{max-h}}^{r_{max-h+1}}\pi(r_{max}^2-y^2)dy}$$

After integrating the equation reduces to:

$$\bar{y}_{weight}=\frac{6r_{max}^2[(r_{max}-h+t)^2-(r_{max}-h)^2]-3[(r_{max}-h+t)^4-(r_{max}-h)^4]}{12r_{max}^2 r-4[(r_{max}-h+t)^3-(r_{max}-h)^3]}$$

The mass of the weighted member 19 is given by:

$$m_{weight}=\rho_{weight}\int_{r\ max-h}^{r\ max-h+1}dV$$

Which upon substitution becomes:

$$m_{weight}=\rho_{weight}\int_{r\ max-h}^{r\ max-h+1}\pi(r_{max}^2-y^2)dy$$

After integrating, reduces to:

$$m_{weight}=\rho_{weight}\frac{\pi}{3}(3r_{max}^2 t-[(r_{max}-h+t)^3-(r_{max}-h)^3])$$

Full Container Stability

The center of gravity of the entire container and its fluid contents is given by:

$$\bar{y}_{bottle}=\frac{-\bar{y}_{cap}m_{cap}-\bar{y}_{stem}m_{stem}+\bar{y}_{fluid\ base}m_{fluid\ base}+\bar{y}_{weight}m_{weight}}{m_{cap}+m_{stem}+m_{fluid\ base}+m_{weight}}$$

The negative signs in the equation are in keeping with the sign convention for the specified coordinate system. The variable h can be written in terms of the specified variables as follows:

$$h=r_{max}+t-\sqrt{r_{max}^2-r_{base}^2}$$

For the container 10 to return to its upright position, the center of gravity 26 of the entire container 10 must be on the positive side of the critical line 21 (i.e., y bottle>y critical). When the container is full, the center of gravity 26 is essentially on the center line 20 of the container 10 for all tilt angles. The center of gravity distance is a measure of how far the center of gravity or point 26 is away from the coordinate center along the center line 20 of the container 10 (FIG. 2). The asymmetry of the nozzle end (FIG. 3) does not significantly displace the center of gravity point 26 from the center line 20. The y coordinate of the point where the critical line and the center line intersect is given by:

$$Y_{critical} = r_{max}\tan\theta$$

$$\text{Where } \theta = \tan^{-1}\left(\frac{r_{max} - r_{flange}}{L+n}\right)$$

Less than Full Container Stability

Figure 9:
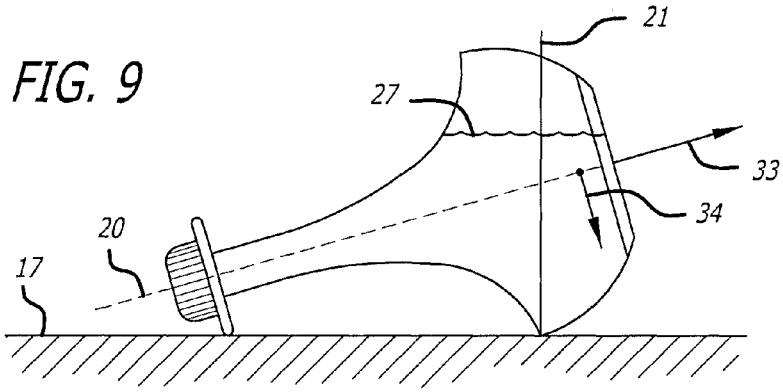
FIG. 9 is a diagrammatic illustration of the shifting center of gravity of the container of FIGS. 1 to 3.

When the container 10 is less than full, the center of gravity position or point 26 will shift with the container tilt angle and fluid level. It is possible for the center of gravity or point 26 to shift in the negative y direction as the fluid level drops. The center of gravity shifts in the positive y direction for most geometries. This results in an increased positive restoring moment. Fluid levels less than full will also cause the center of gravity to shift off the center line 20 when the container is tilted. Any displacement of the center of gravity from the center line 20 is of no concern since it will be in a direction resulting in an increased restoring moment as seen in FIG. 9. Thus, the center of gravity shifts along centerline 20 in the direction of arrow 33 and off centerline 20 in the direction of arrow 34.

The y coordinate of the shifted center of gravity must be checked for various fluid levels to assure it is not less than y critical. This need only be done for the bottle tipped completely on its side as this is the worst case. When recalculating the y shift in the center of gravity, only the integrating of the fluid sections of the container must be repeated.

Partially Filled Stem Section

Figure 11:
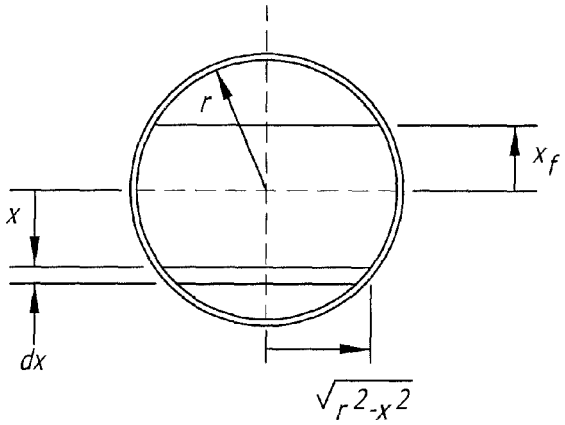
FIG. 11 is a view taken along lines 11-11 of FIG. 10.
Figure 10:
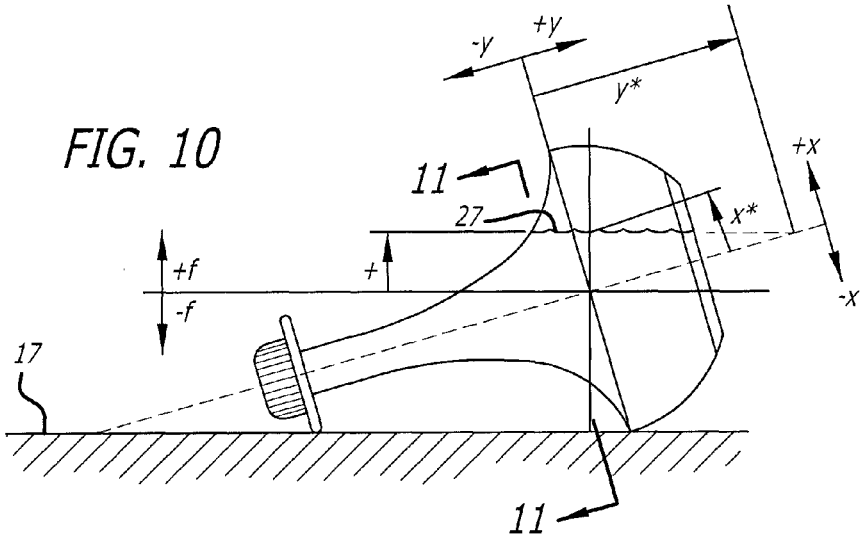
FIG. 10 is a diagrammatic illustration of the geometry of a partially filled container of FIGS. 1 to 3.

To integrate the stem section 12, 13, an expression for the fluid level along the stem section 12, 13 is required. The problem now becomes a double integral. Integration must be performed along the center line 20 and across each section 12, 13 (FIGS. 10 and 11). The integral for the center of gravity of the stem section 12, 13 now becomes:

$$\bar{y}_{stem} = \frac{\int_0^L y \int_{-r}^{xf} 2\sqrt{r^2 - x^2}\, dx dy}{\int_0^L \int_{-r}^{xf} 2\sqrt{r^2 - x^2}\, dx dy}$$

where for the curved portion of the stem section 12, 13:

$$r = (r_{max} - r_{cap})\left[a - b\left(\frac{y}{L}\right) + c\left(\frac{y}{L}\right)^2 - d\left(\frac{y}{L}\right)^3 + e\left(\frac{y}{L}\right)^4\right] + r_{cap}$$

and for the straight portion of the stem section 12, 13:

$$r = r_{cap}$$

The mass of fluid in the stem section is given by:

$$m_{stem} = \rho_{fluid}\int_0^L\int_{-r}^{xf} 2\sqrt{r^2 - x^2}\, dx dy$$

Partially Filled Fluid Base Portion

The integral for the center of gravity of the fluid base portion 11 for a partially filled container now becomes:

$$y_{fluid\ base} = \frac{\int_0^{r_{max}-h} y \int_{-r}^{xf} 2\sqrt{r^2 - x^2}\, dx dy}{\int_0^{r_{max}-h}\int_{-r}^{xf} 2\sqrt{r^2 - x^2}\, dx dy}$$

where for the fluid base $r^2 = r^2_{max} - y^2$

The mass of fluid in the fluid base section is given by:

$$m_{fluid\ base} = \rho_{fluid}\int_0^{r_{max}-h}\int_{-r}^{xf} 2\sqrt{r^2 - x^2}\, dx dy$$

Computer Aided Design

A BASIC computer program is used to aid in the bottle design (Appendix A). The program is divided into two parts. The first part of the program provides various bottle geometries that yield a positive restoring moment for a full bottle lying on its side. A total fluid volume of the bottle must be specified within the program listing. The fixed variables in the program are $y_{cap}$, n (length of the straight portion of the stem section), $P_{fluid}$, $P_{weight}$, $r_{flange}$, $y_{cap}$, $m_{cap}$ and $V_{total}$. The first part of the program searches through a range of L, t, $r_{max}$, and $r_{base}$. All geometries that provide a positive restoring moment for a total volume within a specified error are listed in the output.

The second part of the program analyzes the shift of the center of gravity in the y direction for various levels of fluid. This section of the program requires a given bottle geometry. The center of gravity analysis is for a bottle tipped completely on its side. The user must input L, t, $r_{max}$, and $r_{base}$. Fluid levels are incremented along the f axis (FIG. 10). The variable $x_f$ is expressed in terms of f, the fluid level, as:

$$x_f \frac{f}{\cos\theta} - y\tan\theta$$

The program solves for the y coordinate of the center of gravity for fluid levels ranging from a full bottle, where $f = r_{max}$, to an empty bottle, where $f = -r_{max}\cos\theta$. The number of fluid levels and the number of integration steps can be changed in the program listing.

Results

As a trial run of the computer program a target volume of 16 ounces was chosen. Table 2 gives a list of the specific values and range of values used for various bottle parameters. Twenty (20) integration steps and ten (10) fluid level steps were used for this trial.

TABLE 2

Trial variables

| Nomenclature | Value/Range | Step Size |
|---|---|---|
| $r_{max}$ | 2.00-2.20 [in] | 0.05 [in] |
| t | 0.40-1.00 [in] | 0.05 [in] |
| V | 16 [oz] | +1.0 [oz] |
| $r_{cap}$ | 0.5 [in] | — |
| L | 4.50-5.00 [in] | 0.05 [in] |

TABLE 2-continued

| Trial variables | | |
|---|---|---|
| Nomenclature | Value/Range | Step Size |
| $r_{base}$ | 0.50-2.15 [in] | 0.05 [in] |
| $m_{cap}$ | 0.01 [lbs] | — |

The computer output for the trial run is provided in Appendix B. The output shows that a variety of bottle geometries will work. A number of points must be considered in selecting a specific bottle geometry.

The empty weight of the container must not be excessive to make handling of the container awkward. The base radius should be as large as possible to make tipping the container over as difficult as possible.

Figure 12:
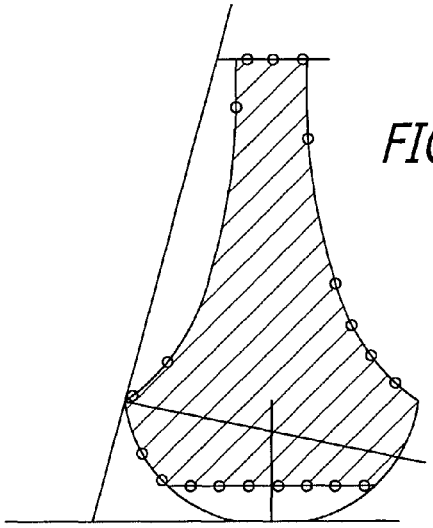
FIG. 12 is a graphical illustration of the geometry of the container of FIGS. 1 to 3.

Table 2 lists the container geometry selected from the trial output of Appendix B for a detailed y coordinate center of gravity analysis. The computer output from this analysis is provided in FIG. 12 wherein:

Hemisphere radius [in]=2.00

Stem height [in]=4.90

Base radius [in]=0.60

Weight thickness [in]=0.55

Total fluid volume [oz]=0.00

Total weight [lbs]=0.94

Empty weight [lbs]=0.94

Delta y [in]=1.02

Center of gravity [in]=1.48

Scale: one inch

TABLE 2

| Selected trial container geometry | |
|---|---|
| Variable | Value/Range |
| $R_{max}$ | 2.00 [in] |
| t | 0.55 [in] |
| V | 16.2 [oz] |
| $r_{cap}$ | 0.5 [in] |
| L | 4.90 [in] |
| $r_{base}$ | 0.60 [in] |

CONCLUSIONS

The analysis of the center of gravity shifts for a container with the dimensions given in Table 2 showing it to have a positive restoring moment for all fluid levels. The empty weight for this container is 0.94 pounds. The minimum distance between the center of gravity and the critical line is 0.011 inches. Although the analysis is considered conservatively, the tolerance for the manufacture of this container would be strict.

The total volume for the trial container is 16.2 ounces. This volume represents the total interior volume of the container. The actual fluid should be less than the total container volume.

It can be seen that there is described a container 10 in the preferred form of a bottle that can right itself after being tipped. This substantially reduces spillage. The container 10 includes a smooth tapered section 13 with a truncated hemispherical base portion 11. The weighted bottom member 19 assists container 10 in righting itself. In order to minimize the weight required to make container 10 self righting, a flange is preferably provided just below cap 15. The flange 18 limits the angle at which container 10 rests when it is tipped completely on its side as seen in FIG. 2.

```
REM                          APPENDIX A
REM            ****************************************
REM
REM                     Stand-Up Bottle Design
REM
REM            ****************************************
REM
REM           **********     Nomenclature     **********
REM    pi = pie
REM    r = radius of hemisphere section
REM    L = height of curved section
REM    dl = length of stem straight section
REM    rbase = radius of base
REM    rcap = radius at cap
REM    r4 = radius of cap flange
REM    t = thickness of weight
REM    fd = fluid density (water)
REM    wd = weight density (lead)
REM    m3 = mass of bottle cap (including spray nozzle)
REM    wtl = lead weight limit
REM    pvol = percent error allowed for volume
REM    evol = absolute error allowed for volume
REM    yn = distance from bottom of flange to centroid of sprayer
REM             **********     constants     **********
pi = 3.14159265#
wtl = 2   :REM [lbs]
dl = .5 :REM [in)
rcap = .5 :REM [in]
r4 = .75 :REM [in]
fd = .03613 :REM    [lbs/in^3)
wd = 11.36*.03613 :REM   [lbs/in^3] Halliday & Resnick extended 3 rd ed.
m3 = .01 :REM   [lbs]
nm = 50   :REM      number of intergration integration steps
Inm = 10  :REM      number of fluid level divisions
REM            ##########################################
vol = 16  :REM      target bottle volume [oz]
REM            ##########################################
pvol = 10 :REM      percent erro error in volume [%]
evol = 1  :REM      absolute error in volume [oz]
yn = 1 :REM [in]
REM    **********    bottle neck curve coefficients   **********
REM    coefficients for forth fourth order polynomial curve fit for
Z(y)
A = 9985        :REM constant
b = 3.6699          :REM Z
c = 6.2854          :REM Z^2
d = 5.5478 :REM z^3
```

```
e = 1.9314 :REM Z^4
REM          **********     choose routine     **********
INPUT "Do you want to analyze various bottle geometries";q$
IF LEFT$(q$,1)="y" THEN 100
IF LEFT$(q$,1)="Y" THEN 100
INPUT "Do you want to analyze a specific bottle geometry";q$
IF LEFT$(q$,1)="y" THEN GOSUB spec
IF LEFT$(q$,1)="Y" THEN GOSUB spec
GOTO 300
100 :CLS
REM        **********     print page header     **********
LPRINT:LPRINT:LPRINT:LPRINT
LPRINT TAB(40);"APPENDIX B"
LPRINT:LPRINT:LPRINT:LPRINT
LPRINT "hemisphere";TAB(15);"stem";TAB(25);"base";
LPRINT TAB(37);"weight";TAB(49);"fluid";TAB(59);"full;
LPRINT TAB(69);"empty";TAB(79);"delta";TAB(88);"center of"
REM
LPRINT SPC(1)"radius";TAB(14);"height";TAB(24);"radius";
LPRINT TAB(35);"thickness";TAB(49);"volume";TAB(59)"weight";
LPRINT TAB(69);"weight";TAB(81);"y";TAB(89);"gravity"
REM
LPRINT SPC(2)"[in]";TAB(15),"[in]";TAB(25);"[in]";
LPRINT TAB(37);"[in]";TAB(49);"[oz.]";TAB(59);"[lbs]";
LPRINT TAB(69);"[lbs]";TAB(80);"[in]";TAB(90),"[in]"
REM      **********     output header to file     **********
OPEN "Bottle Geometries" FOR OUTPUT AS #1
WRITE#1,"APPENDIX B"
WRITE#1,
"hemisphere","stern","base","weight","fluid","full","empty",
"delta","center of"
WRITE#1,"radius","height","radius","thickness","volume","weight"
,"weight","y","gravity"
WRITE#1,"[in]","[in]","[in]","[in]","[oz.]","[lbs]","[in]",
"[in]","[in]"
REM          **********     loop routine     **********
REM          **********     upper limits     **********
ulr=2.2
ulL=5
ult=1
REM          **********     lower limits     **********
llr=2!
llL=4.5
llrb=.5
llt=.4
REM          **********     step sizes     **********
stepr=.05
```

```
stepL=.05
steprb=.05
stept=.05
REM              ************************************
numcalr=((ulr-llr)/stepr)
numcalL=(ulL-llL)/stepL)
numcalrb=(ulr-llrb-.05)/steprb)
numcalt=((ult-llt)/stept)
numcaltl=INT(numcalr*numcalL*numcalrb*numcalt)*1.35
numcal=numcaltl
numcalp=numcal/numcaltl
start=TIMER
PRINT:PRINT
PRINT*run time [min.]="
PRINT
PRINT "percent of calculations remaining ="
PRINT "approximate run time remaining [hr.] ="
PRINT       ********** GEOMETRIES BEING CHECKED **********
PRINT TAB(28) "lower limits",TAB(39);"upper
limits";TAB(50);"step size"
PRINT "hemisphere radius ="
PRINT "stem length ="
PRINT "base radius ="
PRINT "weight thickness ="
REM    **********     screen print lower limits     **********
LOCATE 9,30
PRINT USING "##.##";llr
LOCATE 10,30
PRINT USING "##.##";llL
LOCATE 11,30
PRINT USING "##.##";llrb
LOCATE 12,30
PRINT USING "##.##";llt
REM    **********     screen print upper limits     **********
LOCATE 9,40
PRINT USING "##.##";ulr
LOCATE 10,40
PRINT USING "##.##";ulL
LOCATE 12,40
PRINT USING "##.##";ult
REM     **********     screen print step sizes     **********
LOCATE 9,50
PRINT USING "##.##";stepr
LOCATE 10,50
PRINT USING "##.##";stepL
LOCATE 11,50
PRINT USING "##.##";steprb
```

```
LOCATE 12,50
PRINT USING "##.##";stept
REM              ************************************
LOCATE 5,30
PRINT USING "###.#*;100*numcalp
REM      **********     loop begining beginning     **********
FOR r=llr TO ulr STEP stepr   :REM   hemisphere radius
numcal=numcal-1
numcalp=numcal/numcaltl
LOCATE 5,30
PRINT USING "###.#*;100*numcalp
FOR L=llL TO ulL STEP stepL   :REM stem length
numcal=numcal-1
numcalp=numcal/numcaltl
LOCATE 5,30
PRINT USING "###.#*;100*numcalp
ulrb=r-.05
LOCATE 11,40
PRINT USING "##.##*;ulrb
FOR rbase=llrb TO ulrb STEP steprb
numcal=numcal-1
numcalp=numcal/numcaltl
LOCATE 5,30
PRINT USING "###.#*;100*numcalp
FOR t=llt TO ult STEP stept   :REM    weight thickness
numcal=numcal-1
numcalp=numcal/numcaltl
LOCATE 5,30
PRINT USING "###.#*;100*numcalp
REM              ************************************
LOCATE 9,16
PRINT USING "##.##";r;
LOCATE 10,12
PRINT USING "##.##";L;
LOCATE 11,12
PRINT USING "##.##";rbase;
LOCATE 12,16
PRINT USING "##.##";t
REM              ************************************
h=r+t-(r^2-rbase^2)^.5
alphar=ATN ((r-r4)/(L+d1))    :REM [radian]
f=r
ycrit=r*(r-r4)/(L+d1)
GOSUB cgvol
REM       **********     check stability full     **********
IF dy<0 THEN 200
REM     **********     check for desired volume     **********
```

```
IF VV<vol THEN 200 :REM  lower limit is target volume since fluid volume
REM                      will be less than the bottle volume.
IF VV>vol+evol THEN 200
IF wt>wtl THEN 200
REM      **********      print hardcopy, routine      **********
LPRINT
LPRINT SPC(1);
LPRINT USING "###.##";r;
LPRINT TAB(14);
LPRINT USING "###.##",L;
LPRINT TAB(24);
LPRINT USING "###.##";rbase;
LPRINT TAB(36);
LPRINT USING "###.##";t;
LPRINT TAB(48);
LPRINT USING "###.##";VV;
LPRINT TAB(58);
LPRINT USING "###.##";wt;
LPRINT TAB(68);
LPRINT USING "###.##";we;
LPRINT TAB(79);
LPRINT USING "###.##";dy;
LPRINT TAB(89);
LPRINT USING "###.##";y
REM        **********      output data to file      **********
WRITE#1,r,L,rbase,t,vV,wt,we,dy,y
200 :
finish=TIMER
time=finish-start
etf=time/((1-numcalp)*3600)
LOCATE 3,15
PRINT USING "####.##";time/60
LOCATE 6,33
PRINT USING "###.#";etf
NEXT t
NEXT rbase
NEXT L
NEXT r
300 :
CLOSE#1
END
cgvol:
REM              ************************************
REM              ************************************
REM        This section of the program solves for the total fluid
REM        volume, the bottle center of gravity, and the bottle weights.
REM              ************************************
```

```
REM                 ************************************
REM               **********     centroids     **********
y3 = -(L+dl+yn)      :REM centroid of cap section
y4 = (6*r^2*((r-h+t)^2-(r-h)^2)-3*((r-h+t)^4-(r-h)^4))/ (12*r^2*t-4*((r-
h+t)^3-(r-h)^3))
REM y4 is the centroid of weighted section
REM  ??????????9??????????????????????????????????????
REM  ??????????????? ~~INTERGRATED~~ INTEGRATED METHOD
????????????
REM  ??????????????? FOR CENTROID & VOLUME ??????????
REM  ???????????9??????????????????????????????????????
REM                 ************************************
REM  *** fluid volume & 'y' coordinate ~~centroidin~~ centroid in stem
section **
REM                 ************************************
ms=0
V2=0
Sflag=0
dxmin=.2:REM   default value for dxmin
FOR p=0 TO nm-1 STEP 1
n=p/nm
nn=(p+1)/nm
zz=(r-rcap)*(a+b*n+c*n^2+d*n^3+e*n^4)+rcap
zzz=(r-rcap)*(a+b*nn+c*nn^2+d*nn^3+e*nn^4)+rcap
yy=L*n
yyy=-L*nn
xx=f/(COS(alphar))-yy*TAN(alphar)
xxx=-f/(COS(alphar))-yyy*TAN(alphar)
dx=zz-xx
dxx=zzz-xxx
GOSUB sfilpoints
ddy=yyy-yy
IF dx < 0 THEN dx=0
IF dxx < 0 THEN dxx=0
Zavg=(zz+zzz)/2
Davg=(dx+dxx)/2
Yavg=(yy+yyy)/2
X=(zavg-davg)/zavg
IF x>-1 THEN GOTO 80
Dvol=0
GOTO 90
80 :
Acos=-ATN(x/SQR(-x*x+1.0000001#))+1.5708    :REM arc cosine of x
function
dvol=(pi*zavg^2-zavg^2*acos+(zavg-davg)*(2*zavg*davg-davg^2)^.5)*ddy
90 :
V2=V2-dvol
```

```
ms=ms+dvol*yavg
NEXT p
IF V2>0 THEN 115
Y2=0
GOTO 125
115 :
Y2=-ms/V2
125 :
REM                ************************************
REM  fluid volume & 'y' coordinate centroid in stem straight section
REM                ************************************
me=0
V5=0
sflag=0
GOTO 222
dxmin=.2:REM   default value for dxmin
222 :
zzz=rcap
FOR p=0 TO nm-1 STEP 1
n=p/nm
nn=(p+1)/nm
yy=-L-dl*n
yyy=-L-dl*nn
xx=f/(COS(alphar))-yy*TAN(alphar)
xxx=f/(COS(alphar))-yyy*TAN(alphar)
dx=zzz-xx
dxx=zzz-xxx
GOSUB sfilpoints
ddy=yyy-yy
IF dx < 0 THEN dx=0
IF dxx < 0 THEN dxx=0
zavg=zzz
davg=(dx+dxx)/2
yavg=(yy+yyy)/2
x=(zavg-davg)/zavg
IF x>-1 THEN GOTO 130
dvol=0
GOTO 140
130 :
acos=ATN(x/SQR(-x*x+1.0000001#))+1.5708    :REM arc cosine of x
function
dvol=(pi*zavg^2-zavg^2*acos+(zavg-davg)*(2*zavg*davg-
davg^2)^.5*ddy 140 :
V5.V5-dvol
me=me+dvol*yavg
NEXT p
IF V5>0 THEN 150
```

```
Y5=0
GOTO 160
150 :
Y5=-me/V5
160 :
REM                 ************************************
REM        fluid volume & 'y' coordinate centroid in hemisphere section
REM                 ************************************
V1=0
mh=0
hflag=0
dxmin=.2:REM   default value for dxmin
FOR p=0 TO nm-1 STEP 1
n=p/nm
nn=(p+1)/nm
zz=(r^2-((r-h)*n)^2)^.5
zzz=(r^2-((r-h)*nn)^2)^.5
yy=(r-h)*n
yyy-(r-h)*nn
xx=f/(COS(alphar))-yy*TAN(alphar)
xxx-f/(COS(alphar))-yyy*TAN(alphar)
dx=zz-xx
dxx=zzz-xxx
GOSUB hfilpoints
ddy=yyy-yy
IF dx < 0 THEN dx=0
IF dxx < 0 THEN dxx=0
zavg=(zz+zzz)/2
davg=(dx+dxx)/2
yavg=(yy+yyy)/2
x=(zavg-davg)/zavg
IF x>-1 THEN GOTO 85
dvol=0
GOTO 95
85 :
acos=-ATN(x/SQR(-x*x+1.0000001#))+1.5708   :REM arc cosine of x
function
dvol=(pi*zavg^2-zavg^2*acos+(zavg-davg)*(2*zavg*davg-
davg^2)^.5)*ddy
95 :
V1=V1+dvol
mh=mh+dvol*yavg
NEXT p
IF V1>0 THEN 110
Y1=0
GOTO 120
110 :
```

```
Y1=mh/V1
120 :
REM       ??????????????????????????????????????????????
REM       ??????????????????????????????????????????????
V4 = pi*t*(3*rbase^2+6*r*h-3*h^2+t^2)/6
REM  V4 is the volume of the weighted section
V = V1+V2+V5
VV=V*128/231
REM V is the total fluid volume in in^3
REM VV is the total fluid volume in ounces
REM              **********     weights     **********
fm = fd*V
wm = wd*V4
we=wm+m3
wt=fm+we
REM              ************************************
REM         **********     CENTER OF GRAVITY     **********
REM              ************************************
y =
(Y1*V1*fd+Y2*V2*fd+Y5*V5*fd+m3*y3+y4*V4*wd)/(V1*fd+V2*fd+V5*fd
+m3+V4*wd)
dy=y-ycrit
REM              ************************************
REM              ************************************
RETURN
draw:
REM              ************************************
REM              ************************************
REM          This section of the program draws the bottle
REM              ************************************
REM              ************************************
REM       check for second drawing
REM              ************************************
IF flag=l THEN GOTO 400
flag=1
REM       screen is scaled ss points per inch
xmax=490:ymax=296
lxmax=6.4375
lymax=4.25
ssx=xmax/lxmax
ssy=ymax/lymax
sy=CINT(ymax/(r+L+dl+2))
sx=sy*ssx/ssy
cy=ymax-CINT((r+1)*sy)
cx=xmax-CINT((r+1)*sx)
REM     **********     coordinate system center     **********
LINE(cx,cy+4)-(cx,cy-4)
```

```
LINE(cx+4,cy)-(cx-4,cy)
REM          **********     stem section     **********
FOR p=0 TO nm-1 STEP 1
n=p/nm
nn=(p+1)/nm
zz=(r-rcap)*(a+b*n+c*n^2+d*n^3+e*n^4)+rcap
lzc=cx-CINT(sx*zz)
rzc=cx+CINT(sx*zz)
zzz=(r-rcap)*(a+b*nn+c*nn^2+d*nn^3+e*nn^4)+rcap
lzzc=cx-CINT(sx*zzz)
rzzc=cx+CINT(sx*zzz)
yy=L*n
yyy=L*nn
yc=cy-CINT(sy*yy)
yyc=cy-CINT(sy*yyy)
LINE (rzc,yc)-(rzzc,yyc)
LINE (lzc,yc)-(lzzc,yyc)
NEXT p
REM             ************************************
REM       **********     cap end flang flange     **********
yy=L+dl
yc=cy-CINT(sy*yy)
LINE(rzzc,yyc)-(rzzc,yc)
LINE(lzzc,yyc)-(lzzc,yc)
lzc=cx-CINT(sx*r4)
rzc=cx+CINT(sx*r4)
LINE (rzc,yc)-(lzc,yc)
LINE (rzc,yc-1)-(lzc,yc-1)
Hx1=lzc:hy1=yc-1:REM     horizon line point for tipped bottle
REM          **********     base section     **********
FOR p=0 TO nm-1 STEP 1
n=p/nm
nn=(p+1)/nm
zz=(r^2-((r-h)*n)^2)^.5
lzc=cx-CINT(sx*zz)
rzc=cx+CINT(sx*zz)
zzz=(r^2-((r-h)*nn)^2)^.5
lzzc=cx-CINT(sx*zzz)
rzzc=cx+CINT(sx*zzz)
yy=(r-h)*n
yyy=(r-h)*nn
yc=cy+CINT(sy*yy)
yyc=cy+CINT(sy*yyy)
LINE (rzc,yc)-(rzzc,yyc)
LINE (lzc,yc)-(lzzc,yyc)
NEXT p
LINE(rzzc,yyc)-(lzzc,yyc)
```

```
REM              ************************************
REM          **********     weighted section     **********
FOR p=0 TO nm-1 STEP 1
n=p/nm
nn=(p+1)/nm
zz=(r^2-(r-h+t*n)^2)^.5
lzc=cx-CINT(sx*zz)
rzc=cx+CINT(sx*zz)
zzz=(r^2-(r-h+t*nn)^2)^.5
lzzc=cx-CINT(sx*zzz)
rzzc=cx+CINT(sx*zzz)
yy=r-h+t*n
yyy=r-h+t*nn
yc=cy+CINT(sy*yy)
yyc=cy+CINT(sy*yyy)
LINE (rzc,yc)-(rzzc,yyc)
LINE (lzc,yc)-(lzzc,yyc)
NEXT p
LINE(rzzc,yyc)-(lzzc,yyc)
REM              ************************************
REM            **********     draw horizon     **********
LINE (0, yyc)-(xmax,yyc)
LINE (0,yyc+1)-(xmax,yyc+1)
REM              ************************************
REM        **********     draw tipped horizon     **********
hx2=cx-CINT(sx*r)
hy2=cy
hyy1=0
hxx1=hx1+CINT((hyy1-hy1)*(hx1-hx2)/(hy1-hy2))
hyy2=yyc
hxx2=hx2+CINT((hyy2-hy2)*(hx2-hx1)/(hy2-hy1))
LINE (hxx1,hyy1)-(hxx2,hyy2)
LINE (hxx1+1,hyy1)-(hxx2+1,hyy2)
REM              ************************************
REM         **********     draw critical line     **********
hx1=hx2+CINT((sx*2*r+10)*COS(alphar))
hy1=hy2+CINT((sy*2r+10)*SIN(alphar))
LINE (hx1,hy1)-(hx2,hy2)
REM              ************************************
REM             **********     draw scale     **********
scx=140
scy=220
REM  horizontal
LINE (scx-sx/2,scy)-(scx+sx/2,scy)
LINE (scx-sx/2,scy+1)-(scx+sx/2,scy+1)
LINE (scx-sx/2,scy-3)-(scx-x/2,scy+3)
LINE (scx+sx/2,scy-3)-(scx+sx/2,scy+3)
```

```
REM  vertical
LINE (scx,scy-sy/2)-(scx,scy+sy/2)
LINE (scx+1,scy-sy/2)-(scx+1,scy+sy/2)
LINE (scx-3,scy-sy/2)-(scx+3,scy+sy/2)
LINE (scx-3,scy+sy/2)-(scx+3,scy+sy/2)
REM              ************************************
LOCATE 1,1
PRINT:PRINT
PRINT " Hemisphere radius [in) =";
PRINT USING ##.##";r
PRINT " Stem height [in] =";
PRINT USING "##.##";L
PRINT " Base radius [in] =";
PRINT USING "##.##";rbase
PRINT " Weight thickness [in].=";
PRINT USING "##.##";t
PRINT " Total fluid volume [oz] ="
PRINT " Total weight [lbs] ="
PRINT " Empty weight [lbs] =";
PRINT USING "##.##";we
PRINT " Delta y [in] ="
PRINT " Center of gravity [in] ="
LOCATE 14,1
PRINT " Scale: one inch";
400 :
LOCATE 7,21
PRINT USING "##.##";VV
LOCATE 8,16
PRINT USING "##.##";wt
LOCATE 10,11
PRINT USING "##.##";dy
LOCATE 11,19
PRINT USING "##.##";y
REM              ************************************
REM         **********     center of gravity     **********
cgy=cy+CINT(sy*y)
CIRCLE (cx,cgy),4
LINE(cx-2,cgy)-(cx+2,cgy)
LINE(cx,cgy-2)-(cx,cgy+2)
REM              ************************************
REM          **********     draw fill line     **********
fill=f-empty
fx1=hxx1+CINT(sx*fill/COS(alphar))
fy1=hyy1
fx2=hxx2+CINT(sx*fill/COS(alphar))
fy2=hyy2
IF f=full OR f=empty THEN 640
```

```
GOTO 605
LINE (fx1,fy1)-(fx2,fy2)
605 :
IF fxx3=0 AND fyy3=0 THEN 610
fxx3=cx+fxx3
fyy3=cy+fyy3
CIRCLE (fxx3,fyy3),2
610 :
IF fxx4=0 AND fyy4=0 THEN 620
fxx4=cx+fxx4
fyy4=cy+fyy4
CIRCLE (fxx4,fyy4),2
620 :
IF fxx1=0 AND fyy1=0 THEN 630
fxx1=cx+fxx1
fyy1=cy+fyy1
CIRCLE (fxx1,fyy1),2
630 :
IF hflag=0 THEN 600
fxx2=cx+fxx2
fyy2=cy+fyy2
CIRCLE (fxx2,fyy2),2
600 :
IF dpflag=1 THEN 635
LINE (fxx1,fyy1)-(fxx2,fyy2)
GOTO 640
635 :
IF fxx3=0 OR fxx2=0 THEN 638
LINE (fxx2,fyy2)-(fxx3,fyy3)
638 :
IF fxx4=0 OR fxx1=0 THEN 640
LINE (fxx4,fyy4)-(fxx1,fyy1)
640 :
fxx1 =0
fyy1=0
fxx2=0
fyy2=0
fxx3=0
fyy3=0
fxx4=0
fyy4=0
REM              ************************************
RETURN
spec:
REM              ************************************
REM              ************************************
REM   *******    ANALYZE ANALYSIS IS OF SPECIFIC BOTTLE GEOMETRY    *******
```

```
REM                 ************************************
REM                 ************************************
INPUT " Hemisphere radius [in]";r
INPUT " Stem height [in]";L
INPUT " Base radius [in]";rbase
INPUT " Weight thickness [in]";t
h=r+t-(r^2-rbase^2)^.5
alphar=ATN((r-r4)/(L+dl))     :REM [radian]
full=r
empty=-r*COS(alphar)
ycrit=r*(r-r4)/(L+dl)
flag=0
CLS
FOR f=full TO empty STEP -(full-empty)/lnm
dpflag=0
GOSUB cgvol
GOSUB draw
NEXT f
RETURN
sfilpoints:
REM       ******  determine stem section fill points  ******
IF f=full OR f=empty THEN 550
IF xxx<-rcap AND yyy=-L-dl THEN 550
IF xxx<-zzz THEN 535
IF dxx>0 AND yyy=-L-dl THEN 525
IF ABS(dxx)<dxmin THEN 500
GOTO 550
500 :
fxx1=CINT(sx*zzz)
fyy1=CINT(sy*yyy)
dxmin=ABS(dxx)
sflag=1
GOTO 550
525 :
fxx1=CINT(sx*xxx)
fyy1=CINT(sy*yyy)
sflag = 1
GOTO 550
535 :
IF dpflag=1 THEN 555
IF ABS(zzz+xxx)<dxmin THEN 545
dpflag=1
dxmin=.2
GOTO 550
545 :
fxx3=CINT(sx*xxx)
fyy3=CINT(sy*yyy)
```

```
dxmin=ABS(zzz+xxx)
GOTO 550
555 :
IF ABS(zzz+xxx)<dxmin THEN 556
GOTO 550
556 :
fxx4=CINT(sx*xxx)
fyy4=CINT(sy*yyy)
dxmin=ABS(zzz+xxx)
550 :
REM              ************************************
RETURN
hfilpoints:
REM     *****  determine hemisphere section fill points  *****
IF f=full OR f=empty THEN 750
IF xxx<-(r^2-(r-h)^2)^.5 THEN 740
IF dxx>0 AND yyy=r-h THEN 725
IF ABS(dxx)<dxmin THEN 700
GOTO 750
700 :
fxx2=CINT(sx*zzz)
fyy2-CINT(sy*yyy)
dxmin=ABS(dxx)
hflag=1
GOTO 750
725 :
fxx2=CINT(sx*xxx)
fyy2=CINT(sy*yyy)
hflag=1
GOTO 750
740 :
IF ABS(zzz+xxx)>dxmin THEN 750
fxx2=CINT(sx*zzz)
fyy2=CINT(sy*yyy)
dxmin=ABS(zzz+xxx)
hflag=1
750 :
REM              ************************************
RETURN
```

APPENDIX B

| hemisphere radius [in] | stem height [in] | base radius [in] | weight thickness [in] | fluid volume [oz.] | full weight [lbs] | empty weight [lbs] | delta y [in] | center of gravity [in] |
|---|---|---|---|---|---|---|---|---|
| 2.00 | 4.70 | 0.50 | 0.55 | 16.01 | 1.92 | 0.87 | 0.005 | 0.49 |
| 2.00 | 4.75 | 0.50 | 0.55 | 16.09 | 1.92 | 0.87 | 0.001 | 0.48 |
| 2.00 | 4.75 | 0.55 | 0.55 | 16.04 | 1.95 | 0.90 | 0.013 | 0.49 |
| 2.00 | 4.80 | 0.55 | 0.55 | 16.13 | 1.95 | 0.90 | 0.0 | 0.48 |
| 2.00 | 4.80 | 0.60 | 0.55 | 16.07 | 1.99 | 0.94 | 0.0 | 0.49 |
| 2.00 | 4.80 | 0.75 | 0.5 | 16.06 | 1.96 | 0.92 | 0.0 | 0.47 |
| 2.00 | 4.85 | 0.55 | 0.55 | 16.21 | 1.96 | 0.90 | 0.0 | 0.47 |
| 2.00 | 4.85 | 0.60 | 0.55 | 16.15 | 1.99 | 0.94 | 0.0 | 0.48 |
| 2.00 | 4.90 | 0.60 | 0.55 | 16.23 | 2.00 | 0.94 | 0.011 | 0.48 |
| 2.05 | 4.50 | 0.50 | 0.55 | 16.63 | 1.98 | 0.89 | 0.020 | 0.55 |
| 2.05 | 4.50 | 0.70 | 0.5 | 16.59 | 1.98 | 0.89 | 0.012 | 0.55 |
| 2.05 | 4.50 | 0.90 | 0.45 | 16.46 | 1.99 | 0.92 | 0.004 | 0.54 |
| 2.05 | 4.55 | 0.50 | 0.55 | 16.72 | 1.98 | 0.89 | 0.017 | 0.54 |
| 2.05 | 4.55 | 0.70 | 0.5 | 16.68 | 1.98 | 0.89 | 0.009 | 0.54 |
| 2.05 | 4.60 | 0.50 | 0.55 | 16.80 | 1.99 | 0.89 | 0.013 | 0.54 |
| 2.05 | 4.60 | 0.70 | 0.5 | 16.76 | 1.99 | 0.89 | 0.005 | 0.53 |
| 2.05 | 4.65 | 0.50 | 0.55 | 16.89 | 1.99 | 0.89 | 0.009 | 0.53 |
| 2.05 | 4.65 | 0.70 | 0.5 | 16.85 | 1.99 | 0.89 | 0.001 | 0.52 |
| 2.05 | 4.70 | 0.50 | 0.55 | 16.97 | 2.00 | 0.89 | 0.005 | 0.52 |

I claim:

1. A self righting fluid containing container adapted to self-right itself when empty from a fully reclining position on a supporting surface having a center of gravity and comprising:

a base portion having a terminal end and a flat bottom at its terminal end and a hollow fluid holding interior;

a neck portion integral with said base portion providing a one-piece container having a throughbore, said neck portion having a diameter from one side to the other;

a tapered section having a throughbore interconnecting said throughbore through said neck portion to said interior of said base portion;

a cap closing off said neck portion, an integral outwardly extending peripheral flange having a diameter across the flange from one side to the other, said flange diameter being greater than the neck portion diameter of said neck portion mounted on said neck portion; and a weighted member disposed in said base portion, the center of gravity of said container being located on one side of a critical line extending from a first point at an intersection of said base portion with said tapered section when said container is empty of fluid and is fully inclined on a supporting surface wherein said cap abuts against said supporting surface and said critical line extends generally normal to the plane of said supporting surface, said container having a centerline from said cap to said base portion, said center of gravity also being located along the centerline of said container, away from said critical line and toward said weighted member, said container movable to a self-righting position from its fully inclined position when empty, and wherein said critical line is vertical when the cap abuts against said supporting surface, wherein said base portion is a truncated hemispherical shaped section, the truncated base having a defined line where it interfaces the neck portion, and the neck portion from the defined interface line being a solely inwardly concave tapered curve from the interface line towards the centerline of the container as the neck is directed towards the cap.

2. In the container of claim 1 wherein said flange is integral with said cap.

3. In the container of claim 1, when said container is in its fully reclining position on its side on said supporting surface, the centerline of said container makes an angle a with a plane of said supporting surface, said critical line also making an angle a with a line extending from a second point of said container at said cap to an uppermost point where said tapered section intersects with said base portion when said container is inclined on said supporting surface.

4. In the container of claim 1 wherein said base portion is a truncated hemispherical shaped section.

5. In the container of claim 1 wherein said base portion has an outer surface and an inner surface, the outer surface of said base portion smoothly curves from said bottom up to the intersection with said tapered section.

6. A self righting fluid containing container adapted to self-right itself when empty from a fully reclining position on a supporting surface having a center of gravity and comprising:

a base portion having a terminal end and a flat bottom at its terminal end and a hollow fluid holding interior;

a neck portion integral with said base portion providing a one-piece container having a throughbore, said neck portion having a diameter from one side to the other;

a tapered section having a throughbore interconnecting said throughbore through said neck portion to said interior of said base portion;

a cap closing off said neck portion, such that the end of the cap is sealed without an aperture so as to be fluid tight fit with the neck, and fluid contents from the container cannot be expelled through the cap, and wherein the cap needs to be removed from the neck to permit fluid expulsion from the container, an integral outwardly extending peripheral flange having a diameter across the flange from one side to the other, said flange diameter being greater than the neck portion diameter of said neck portion mounted on said neck portion; and a weighted member disposed in said base portion, the center of gravity of said container being located on one side of a critical line extending from a first point at an intersection of said base portion with said tapered section when said container is empty of fluid and is fully inclined on a supporting surface wherein said cap abuts against said supporting surface and said critical line extends generally normal to the plane of said supporting surface, said container having a centerline from said cap to said base portion, said center of gravity also being located along the centerline of said container, away from said critical line and toward said weighted member, said container movable to a self-righting position from its fully inclined position when empty, wherein said base portion is a truncated hemispherical shaped section, the truncated base having a defined line where it interfaces the neck portion, and the neck portion from the defined interface line being a solely inwardly concave tapered curve from the interface line towards the centerline of the container as the neck is directed towards the cap.

7. In the container of claim 6 wherein said flange is integral with said cap.

8. In the container of claim 6, when said container is in its fully reclining position on its side on said supporting surface, the centerline of said container makes an angle a with the plane of said supporting surface, said critical line also making an angle a with a line extending from a second point of said container at said cap to an uppermost point where said tapered section intersects with said base portion when said container is inclined on said supporting surface.

9. In the container of claim 6 wherein said base portion has an outer surface and an inner surface, the outer surface of said base portion smoothly curves from said bottom up to the intersection with said tapered section.

10. In the container of claim 6 said critical line is vertical when the cap abuts against said supporting surface.

11. A self righting fluid containing container adapted to self-right itself when empty from a fully reclining position on a supporting surface having a center of gravity and comprising:

a base portion having a terminal end and a flat bottom at its terminal end and a hollow fluid holding interior;

a neck portion integral with said base portion providing a one-piece container having a throughbore, said neck portion having a diameter from one side to the other;

a tapered section having a throughbore interconnecting said throughbore through said neck portion to said interior of said base portion;

a cap closing off said neck portion, a sprayer portion affixed to the cap, the sprayer being normally sealed so as to be fluid tight fit with the cap, and fluid contents from the container cannot be expelled through the sprayer, and wherein the sprayer portion includes a trigger for finger activation to permit fluid expulsion from the container, an integral outwardly extending peripheral flange having a diameter across the flange from one side to the other, said flange diameter being greater than the neck portion diameter of said neck portion mounted on said neck portion; and a weighted member disposed in said base portion, the center of gravity of said container being located on one side of a critical line extending from a first point at an intersection of said base portion with said tapered section when said container is empty of fluid and is fully inclined on a supporting surface wherein said cap abuts against said supporting surface and said critical line extends generally normal to the plane of said supporting surface, said container having a centerline from said cap to said base portion, said center of gravity also being located along the centerline of said container, away from said critical line and toward said weighted member, said container movable to a self-righting position from its fully inclined position when empty, wherein said base portion is a truncated hemispherical shaped section, the truncated base having a defined line where it interfaces the neck portion, and the neck portion from the defined interface line being a solely inwardly concave tapered curve from the interface line towards the centerline of the container as the neck is directed towards the cap.

12. In the container of claim 11 wherein said flange is integral with said cap.

13. In the container of claim 11, when said container is in its fully reclining position on its side on said supporting surface, the centerline of said container makes an angle a with the plane of said supporting surface, said critical line also making an angle a with a line extending from a second point of said container at said cap to an uppermost point where said tapered section intersects with said base portion when said container is inclined on said supporting surface.

14. In the container of claim 11 wherein said base portion has an outer surface and an inner surface, the outer surface of said base portion smoothly curves from said bottom up to the intersection with said tapered section.

15. In the container of claim 11 said critical line is vertical when the cap abuts against said supporting surface.

* * * * *